US009077072B2

(12) United States Patent
Song et al.

(10) Patent No.: US 9,077,072 B2
(45) Date of Patent: Jul. 7, 2015

(54) ANTENNA SYSTEM AND FILTER

(75) Inventors: Hyok Jae Song, Camarillo, CA (US); Carson R. White, Westlake Village, CA (US); Yoon Yeong, Thousand Oaks, CA (US); Eray Yasan, Canton, MI (US)

(73) Assignee: GENERAL MOTORS LLC, Detroit, MI (US)

( * ) Notice: Subject to any disclaimer, the term of this patent is extended or adjusted under 35 U.S.C. 154(b) by 994 days.

(21) Appl. No.: 12/886,322

(22) Filed: Sep. 20, 2010

(65) Prior Publication Data

US 2012/0068897 A1 Mar. 22, 2012

(51) Int. Cl.

| | |
|---|---|
| ***H01Q 21/00*** | (2006.01) |
| ***H01Q 1/32*** | (2006.01) |
| ***H01Q 1/52*** | (2006.01) |
| ***H01Q 21/28*** | (2006.01) |

(52) U.S. Cl.

CPC ..... *H01Q 1/3275* (2013.01); *H01Q 1/521* (2013.01); *H01Q 21/28* (2013.01)

(58) Field of Classification Search

USPC ..... 343/713, 702, 725, 700 MS

See application file for complete search history.

(56) References Cited

U.S. PATENT DOCUMENTS

| | | | | |
|---|---|---|---|---|
| 5,124,713 | A | 6/1992 | Mayes et al. | |
| 5,543,386 | A | 8/1996 | Findikoglu et al. | |
| 5,610,620 | A * | 3/1997 | Stites et al. | 343/725 |
| 5,631,446 | A | 5/1997 | Quan | |
| 5,689,216 | A | 11/1997 | Sturdivant | |
| 5,973,648 | A * | 10/1999 | Lindenmeier et al. | 343/713 |
| 6,032,054 | A | 2/2000 | Schwinke | |
| 6,211,831 | B1 | 4/2001 | Nagy et al. | |
| 6,219,002 | B1 | 4/2001 | Lim | |
| 6,366,249 | B1 | 4/2002 | Jones et al. | |
| 6,417,747 | B1 | 7/2002 | Dearden et al. | |
| 6,424,300 | B1 | 7/2002 | Sanford et al. | |
| 6,617,943 | B1 | 9/2003 | Fazelpour | |
| 6,728,113 | B1 | 4/2004 | Knight et al. | |
| 6,765,574 | B1 | 7/2004 | Mao et al. | |
| 6,795,741 | B2 | 9/2004 | Simon | |
| 6,847,276 | B2 | 1/2005 | Tamaki et al. | |
| 6,853,337 | B2 | 2/2005 | Barabash | |
| 6,861,991 | B2 | 3/2005 | Mueller et al. | |
| 7,015,860 | B2 | 3/2006 | Alsliety | |
| 7,053,845 | B1 * | 5/2006 | Holloway et al. | 343/725 |
| 7,079,082 | B2 | 7/2006 | Iskander et al. | |
| 7,233,296 | B2 | 6/2007 | Song et al. | |
| 7,342,547 | B2 | 3/2008 | Maniwa et al. | |
| 7,427,961 | B2 | 9/2008 | Song et al. | |

(Continued)

OTHER PUBLICATIONS

U.S. Office Action, dated Dec. 13, 2011, for U.S. Appl. No. 12/622,683.

(Continued)

*Primary Examiner* — Hoang V Nguyen
*Assistant Examiner* — Hai Tran
(74) *Attorney, Agent, or Firm* — Ingrassia Fisher & Lorenz, P.C.

(57) ABSTRACT

Antenna systems and antenna filters are provided, for example for use in a windshield or on a roof of a vehicle. An antenna system comprises a first antenna, a second antenna, and a filter. The first antenna is configured to operate at a first frequency. The second antenna is configured to operate at a second frequency. The filter is coupled to the first antenna. The filter is configured to create an open circuit condition at the second frequency and reduce secondary radiation between the first and second antennas.

20 Claims, 3 Drawing Sheets

(56) References Cited

U.S. PATENT DOCUMENTS

| | | | | |
|---|---|---|---|---|
| 7,710,325 | B2 | 5/2010 | Cheng | |
| 8,098,205 | B2 | 1/2012 | Rabinovich et al. | |
| 2003/0103010 | A1* | 6/2003 | Boyle | 343/702 |
| 2005/0219136 | A1 | 10/2005 | Iskander et al. | |
| 2008/0042903 | A1 | 2/2008 | Cheng | |
| 2009/0009399 | A1 | 1/2009 | Gaucher et al. | |
| 2009/0289852 | A1 | 11/2009 | Li et al. | |
| 2010/0164790 | A1 | 7/2010 | Wisnewski et al. | |
| 2011/0018656 | A1 | 1/2011 | Lee et al. | |
| 2011/0037656 | A1 | 2/2011 | Bremner et al. | |

OTHER PUBLICATIONS

Hopf, J.F. et al. "Compact Multi-antenna System for Cars with Electrically Invisible Phone Antennas for SDARS Frequencies," 2nd International ITG Conference on Antennas, Mar. 2007, pp. 171-175.
Chiu, C-Y., et al. "Reduction of Mutual Coupling Between Closely-Packed Antenna Elements," IEEE Transactions on Antennas and Propagation, Jun. 2007, pp. 1732-1738, vol. 55, No. 6.
Andersen, J., et al. "Decoupling and Descattering Networks for Antennas," IEEE Transactions on Antennas and Propagation, Nov. 1976, pp. 841-846, vol. 24, No. 6.
Houdart, M., et al. "Various Excitation of Coplanar Waveguide," IEEE MTT-S International Microwave Symposium Digest, Apr. 1979, pp. 116-118, vol. 79, No. 1.
Lin, T.-H. "Via-free broadband microstrip to CPW transition," IEEE Electronic Letters, Jul. 19, 2001, pp. 960-961, vol. 37, No. 15.
Ellis, T.J., et al. "A wideband CPW-to-microstrip transition for millimeter-wave packaging," IEEE MTT-S International Microwave Symposium Digest, 1999, pp. 629-632, vol. 2.
White, C. R., et al. Connector Assembly and Method of Assembling a Connector Arrangement Utilizing the Connector Assembly, U.S. Appl. No. 12/622,683, filed Nov. 20, 2009.
Final Office Action, dated May 10, 2012, for U.S. Appl. No. 12/622,683.
Response to Final Office Action, dated Jun. 29, 2012, for U.S. Appl. No. 12/622,683.
Notice of Allowance, dated Jul. 18, 2012, for U.S. Appl. No. 12/622,683.
White, C. R., et al. "Microwave Antenna Assemblies," U.S. Appl. No. 12/886,310, filed Sep. 20, 2010.
Response to Office Action, dated Mar. 13, 2012, for U.S. Appl. No. 12/622,683.
Song, H.J., et al. "Multi-Function Antenna," U.S. Appl. No. 12/952,992, filed Nov. 23, 2010.
Waterhouse, R.B., et al. "Small Folded CPW Fed Slot Antennas," IEEE Antennas and Propagation Society International Symposium, Jul. 2006, pp. 2599-2602.
Jan, J.-Y., et al. "Wideband CPW-fed Slot Antenna for DCS, PCS, 3G and Bluetooth Bands," IEEE Electronics Letters, Nov. 23, 2006, pp. 1377-1378, vol. 42, No. 24.
Sze, J.-Y., et al., "Circularly Polarized Square Slot Antenna With a Pair of Inverterd-L Grounded Strips," IEEE Antennas and Wireless Propagation Letters, 2008, pp. 149-151, vol. 7.
Bao, X., et al., "Dual-Frequency Dual-Sense Circularly-Polarized Slot Antenna Fed by Microstrip Line," IEEE Transactions on Antennas and Propagation, Mar. 2008, pp. 645-649, vol. 56, No. 3.
Notice of Allowance, dated Sep. 13, 2012, for U.S. Appl. No. 12/622,683.
Office Action, dated Oct. 26, for U.S. Appl. No. 12/886,310.
Robert A. Sainati, CAD of Microstrip for Wireless Applications, ISBN 0-89006-562-4, 1996, pp. 29-30 and 92-94.
Chen, C., et al., "Dual-band dual-sense circularly-polarized CPW-fed slot antenna with two spiral slots loaded," IEEE Transactions on Antennas and Propagation, Jun. 2009, pp. 1829-1833, vol. 57, No. 6.
USPTO, Final Office Action in U.S. Appl. No. 12/886,310, mailed Apr. 5, 2013.
USPTO, Response to Final Office Action in U.S. Appl. No. 12/886,310, mailed Jun. 3, 2013.
Notice of Allowance, dated Nov. 25, 2011 for U.S. Appl. No. 12/886,310, 2011.
Office Action, dated Feb. 14, 2013, for U.S. Appl. No. 12/952,992, 2013.
Office Action, dated Aug. 6, 2013, for U.S. Appl. No. 12/952,992, 2013.
Notice of Allowance, dated Nov. 15, 2013 for U.S. Appl. No. 21/952,992, 2013.
Olshansky, I., US Patent Application U.S. Appl. No. 14/323,387 entitled "Vehicle Radar Control," filed on Jul. 3, 2014, 2014.

* cited by examiner 10
14
48
50
12
16
18
70
20
24
52
66
54
34
36
32
68
44
72
38
42
56
64
62
58
46
25
22
40
30
60
26
28

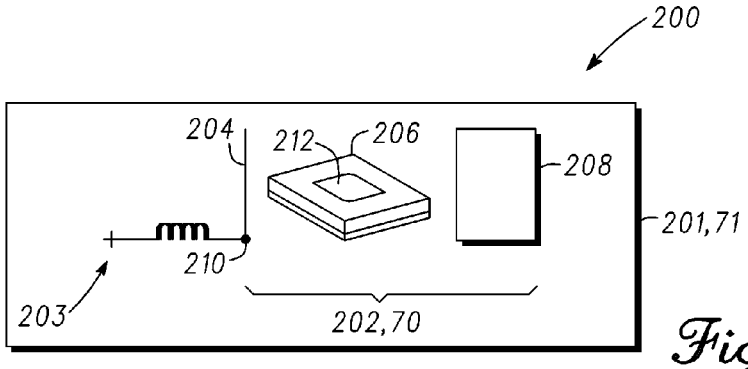
Fig. 2
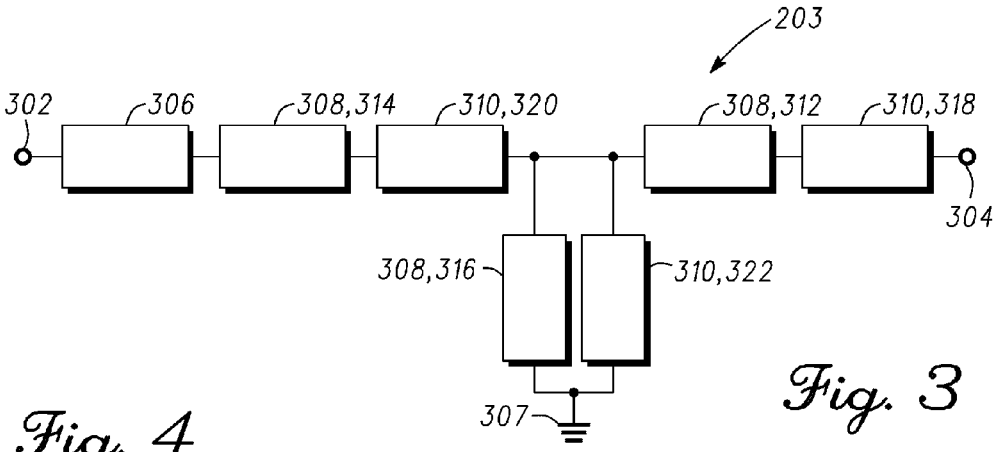
Fig. 3
Fig. 4
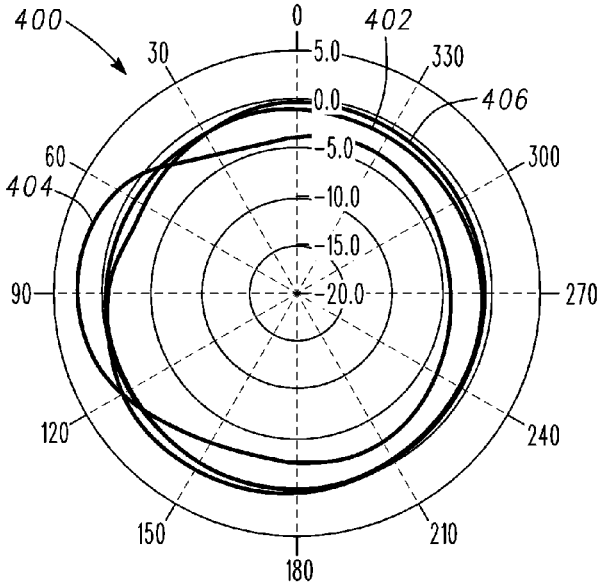
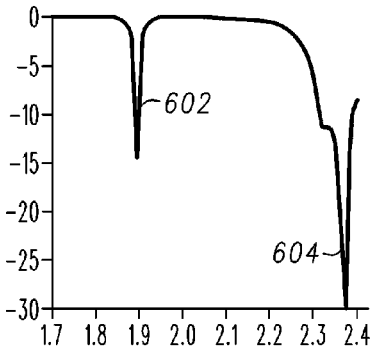
Fig. 6

ANTENNA SYSTEM AND FILTER

TECHNICAL FIELD

The technical field generally relates to antennas, and, more particularly, to antenna systems and filters for antennas, such as in vehicles.

BACKGROUND

In certain applications, multiple antennas of different operating frequencies may be co-located in proximity to one another. For example, certain vehicles, such as various automobiles, include multiple antennas of different operating frequencies within a small housing placed on the vehicle roof. Such antennas may include, by way of example, one or more monopole antennas (such as a Cell or PCS antenna) and one or more patch antennas (for example, for use with a global positioning system (GPS) device or satellite radio for the vehicle). However, the placement of such different antennas in close proximity to one another in a small housing, such as on the roof of a vehicle, may produce undesired secondary radiation from one or more of the antennas.

Accordingly, it is desirable to provide an improved antenna system, for example that reduces secondary radiation between multiple antennas having different operating frequencies, such as on the roof of a vehicle. It is also desirable to provide an improved filter for an antenna system, for example that reduces secondary radiation between antenna pairs having different operating frequencies, such as on the roof of a vehicle. Furthermore, other desirable features and characteristics of the present invention will become apparent from the subsequent detailed description and the appended claims, taken in conjunction with the accompanying drawings and the foregoing technical field and background.

SUMMARY

In accordance with one example, an antenna system is provided. The antenna system comprises an antenna and a filter. The antenna is configured to operate at a first frequency. The filter is coupled to the first antenna. The filter is configured to create an open circuit condition at a second frequency and reduce secondary radiation from the first antenna at the second frequency.

In accordance with another example, a filter for an antenna system comprising a first antenna configured to operate at a first frequency and a second antenna configured to operate at a second frequency is provided. The filter comprises an input port, an output port, transmission lines, inductors and capacitors. The input port is configured to be coupled to the first antenna. The output port is configured to be coupled to a receiver for the first antenna. The transmission line is coupled between the input port or the output port and a combination of the inductors and capacitors. The transmission line between the input port and the combination of the inductors and capacitors is configured to adjust a phase of the filter to generate an open circuit condition at the second frequency.

In accordance with a further example, an antenna system is provided. The antenna system comprises a first antenna, a second antenna, and a filter. The first antenna is configured to operate at a first frequency. The second antenna is configured to operate at a second frequency. The filter is coupled to the first antenna. The filter is configured to create an open circuit condition at the second frequency and reduce secondary radiation between the first and second antennas.

BRIEF DESCRIPTION OF THE DRAWINGS

Certain examples of the present disclosure will hereinafter be described in conjunction with the following drawing figures, wherein like numerals denote like elements, and wherein:

FIG. 2 is a schematic illustration of a non-limiting example of an antenna system, that can be installed on a vehicle roof or on a windshield of and/or otherwise used in connection with the communication system, the vehicle, and the telematics unit of FIG. 1;

FIG. 3 is a functional block diagram of a non-limiting example of a filter of the antenna system of FIG. 2;

FIG. 4 is a first non-limiting, graphical representation, namely, a series of antenna radiation patterns, illustrating the effectiveness of the antenna system of FIG. 2 and the filter of FIG. 3;

FIG. 6 is a third non-limiting, graphical representation, namely, a series of return loss plots, further illustrating the effectiveness of the antenna system of FIG. 2 and the filter of FIG. 3.

DETAILED DESCRIPTION

Figure 1:
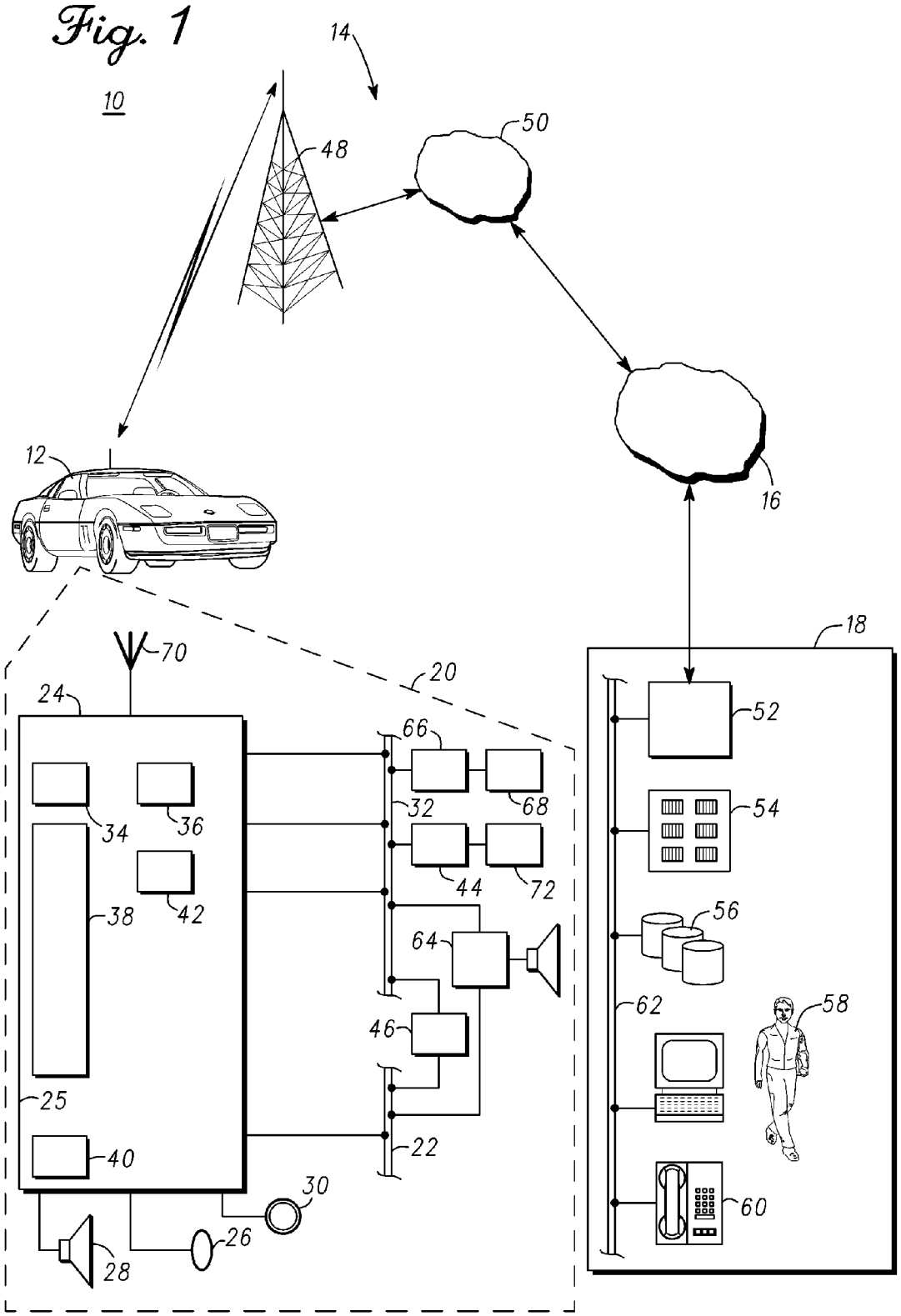
FIG. 1 is a schematic illustration of a non-limiting example of a communication system, including a telematics unit, for a vehicle.

The following detailed description is merely exemplary in nature, and is not intended to limit the disclosure or the application and uses thereof. Furthermore, there is no intention to be bound by any expressed or implied theory presented in the preceding technical field, background, or the following With reference to FIG. 1, there is shown a non-limiting example of a communication system 10 that may be used together with examples of the systems disclosed herein. The communication system generally includes a vehicle 12, a wireless carrier system 14, a land network 16 and a call center 18. It should be appreciated that the overall architecture, setup and operation, as well as the individual components of the illustrated system are merely exemplary and that differently configured communication systems may also be utilized to implement the examples of the method disclosed herein. Thus, the following paragraphs, which provide a brief overview of the illustrated communication system 10, are not intended to be limiting.

Vehicle 12 may be any type of mobile vehicle such as a motorcycle, car, truck, recreational vehicle (RV), boat, plane, and the like, and is equipped with suitable hardware and software that enables it to communicate over communication system 10. Some of the vehicle hardware 20 is shown generally in FIG. 1 including a telematics unit 24, a microphone 26, a speaker 28, and buttons and/or controls 30 connected to the telematics unit 24. Operatively coupled to the telematics unit 24 is a network connection or vehicle bus 32. Examples of suitable network connections include a controller area network (CAN), a media oriented system transfer (MOST), a local interconnection network (LIN), an Ethernet, and other appropriate connections such as those that conform with known ISO (International Organization for Standardization), SAE (Society of Automotive Engineers), and/or IEEE (Institute of Electrical and Electronics Engineers) standards and specifications, to name a few.

The telematics unit 24 is an onboard device that provides a variety of services through its communication with the call center 18, and generally includes an electronic processing device 38, one or more types of electronic memory 40, a cellular chipset/component 34, a wireless modem 36, a dual mode antenna 70, and a navigation unit containing a GPS chipset/component 42. In one example, the wireless modem 36 includes a computer program and/or set of software routines adapted to be executed within the electronic processing device 38. The dual mode antenna 70 is preferably disposed within a windshield 71 of the vehicle 12. In addition, the dual mode antenna 70 preferably comprises and/or is implemented in connection with an antenna system and/or filter, for example as depicted in FIGS. 2 and 3 and described further below in connection therewith.

The telematics unit 24 may provide various services including: turn-by-turn directions and other navigation-related services provided in conjunction with the GPS chipset/component 42; airbag deployment notification and other emergency or roadside assistance-related services provided in connection with various crash and/or collision sensor interface modules 66 and collision sensors 68 located throughout the vehicle; and/or infotainment-related services where music, internet web pages, movies, television programs, videogames, and/or other content are downloaded by an infotainment center 46 operatively connected to the telematics unit 24 via vehicle bus 32 and audio bus 22. In one example, downloaded content is stored for current or later playback. The above-listed services are by no means an exhaustive list of all the capabilities of telematics unit 24, but are simply an illustration of some of the services that the telematics unit may be capable of offering. It is anticipated that telematics unit 24 may include a number of additional components in addition to and/or different components from those listed above. The telematics unit 24 comprises and/or is implemented in connection with an antenna system and/or filter, for example as depicted in FIGS. 2 and 3 and described further below in connection therewith.

Vehicle communications may use radio transmissions to establish a voice channel with wireless carrier system 14 so that both voice and data transmissions can be sent and received over the voice channel. Vehicle communications are enabled via the cellular chipset/component 34 for voice communications and the wireless modem 36 for data transmission. In order to enable successful data transmission over the voice channel, wireless modem 36 applies some type of encoding or modulation to convert the digital data so that it can be communicated through a vocoder or speech codec incorporated in the cellular chipset/component 34. Any suitable encoding or modulation technique that provides an acceptable data rate and bit error can be used with the present examples. Dual mode antenna 70 services the GPS chipset/component 42 and the cellular chipset/component 34.

Microphone 26 provides the driver or other vehicle occupant with a means for inputting verbal or other auditory commands, and can be equipped with an embedded voice processing unit utilizing a human/machine interface (HMI) technology known in the art. Conversely, speaker 28 provides audible output to the vehicle occupants and can be either a stand-alone speaker specifically dedicated for use with the telematics unit 24 or can be part of a vehicle audio component 64. In either event, microphone 26 and speaker 28 enable vehicle hardware 20 and call center 18 to communicate with the occupants through audible speech. The vehicle hardware also includes one or more buttons and/or controls 30 for enabling a vehicle occupant to activate or engage one or more of the vehicle hardware 20 components. For example, one of the buttons and/or controls 30 can be an electronic pushbutton used to initiate voice communication with call center 18 (whether it be a human such as advisor 58 or an automated call response system). In another example, one of the buttons and/or controls 30 can be used to initiate emergency services.

The audio component 64 is operatively connected to the vehicle bus 32 and the audio bus 22. The audio component 64 receives analog information, rendering it as sound, via the audio bus 22. Digital information is received via the vehicle bus 32. The audio component 64 provides amplitude modulated (AM) and frequency modulated (FM) radio, compact disc (CD), digital video disc (DVD), and multimedia functionality independent of the infotainment center 46. Audio component 64 may contain a speaker system, or may utilize speaker 28 via arbitration on vehicle bus 32 and/or audio bus 22.

The vehicle crash and/or collision detection sensor interface 66 is operatively connected to the vehicle bus 32. The collision sensors 68 provide information to the telematics unit via the crash and/or collision detection sensor interface 66 regarding the severity of a vehicle collision, such as the angle of impact and the amount of force sustained.

Vehicle sensors 72, connected to various sensor interface modules 44 are operatively connected to the vehicle bus 32. Exemplary vehicle sensors include but are not limited to gyroscopes, accelerometers, magnetometers, emission detection, and/or control sensors, and the like. Exemplary sensor interface modules 44 include powertrain control, climate control, and body control, to name but a few.

Wireless carrier system 14 may be a cellular telephone system or any other suitable wireless system that transmits signals between the vehicle hardware 20 and land network 16. According to an example, wireless carrier system 14 includes one or more cell towers 48, base stations and/or mobile switching centers (MSCs) 50, as well as any other networking components required to connect the wireless carrier system 14 with land network 16. As appreciated by those skilled in the art, various cell tower/base station/MSC arrangements are possible and could be used with wireless carrier system 14. For example, a base station and a cell tower could be co-located at the same site or they could be remotely located, and a single base station could be coupled to various cell towers or various base stations could be coupled with a single MSC, to list but a few of the possible arrangements. A speech codec or vocoder may be incorporated in one or more of the base stations, but depending on the particular architecture of the wireless network, it could be incorporated within a Mobile Switching Center or some other network components as well.

Land network 16 can be a conventional land-based telecommunications network that is connected to one or more landline telephones, and that connects wireless carrier system 14 to call center 18. For example, land network 16 can include a public switched telephone network (PSTN) and/or an Internet protocol (IP) network, as is appreciated by those skilled in the art. Of course, one or more segments of the land network 16 can be implemented in the form of a standard wired network, a fiber or other optical network, a cable network, other wireless networks such as wireless local networks (WLANs) or networks providing broadband wireless access (BWA), or any combination thereof.

Call center 18 is designed to provide the vehicle hardware 20 with a number of different system back-end functions and, according to the example shown here, generally includes one or more switches 52, servers 54, databases 56, advisors 58, as well as a variety of other telecommunication/computer equipment 60. These various call center components are suitably coupled to one another via a network connection or bus 62, such as the one previously described in connection with the vehicle hardware 20. Switch 52, which can be a private branch exchange (PBX) switch, routes incoming signals so that voice transmissions are usually sent to either the live advisor 58 or an automated response system, and data transmissions are passed on to a modem or other piece of telecommunication/computer equipment 60 for demodulation and further signal processing. The modem or other telecommunication/computer equipment 60 may include an encoder, as previously explained, and can be connected to various devices such as a server 54 and database 56. For example, database 56 could be designed to store subscriber profile records, subscriber behavioral patterns, or any other pertinent subscriber information. Although the illustrated example has been described as it would be used in conjunction with a manned call center 18, it will be appreciated that the call center 18 can be any central or remote facility, manned or unmanned, mobile or fixed, to or from which it is desirable to exchange voice and data.

FIG. 2 is a schematic illustration of a non-limiting example of an antenna system 200. The antenna system 200 preferably comprises a vehicle mounted multi-service antenna module, for example that may house antennas for cellular, PCS, GPS, and/or satellite radio services. The antenna system 200 can be installed within and/or otherwise used in connection with the communication system 10, the vehicle 12, and the telematics unit 24 of FIG. 1.

As depicted in FIG. 2, the antenna system 200 includes a housing 201, two or more antennas 202, and a filter 203. The housing preferably comprises the windshield 71 of the vehicle 12 of FIG. 1. In addition, one or more of the antennas 202 preferably correspond to the antenna 70 of FIG. 1 and/or components thereof As shown in FIG. 2, the antennas 202 include a first antenna 204, a second antenna 206, and one or more third antennas 208. In the depicted example, the first antenna 204 comprises a monopole antenna, preferably a PCS monopole antenna configured to operate at a first frequency of approximately 1.9 GHz. The first antenna has a first port 210. Also in the depicted example, the second antenna 206 comprises a patch antenna, most preferably a satellite radio patch antenna configured to operate at a second frequency of approximately 2.34 GHz. The second antenna 206 has a second port 212. The antenna system 200 may also include any number of types of third antennas 208, such as, by way of example only, a global position system (GPS) antenna. In certain examples, the antenna system 200 comprises only two antennas 204, 206. In addition, the number and/or types of the first, second, and third antennas 204, 206, 208 may vary in different examples.

In one example, the first and second antennas 204, 206 are separated by a distance of a quarter wavelength ($\lambda/4$) at the second operating frequency or higher operating frequency. Without the use of the filter 203, the second antenna 206 would experience the most negative impact on its antenna performance. This is because currents can be effectively induced on the PCS monopole antenna, which is electrically large (~0.3$\lambda$) at the second frequency by the radiated field from the second antenna 206. Without the use of the filter 203, the induced currents on the first antenna 204 would result in a secondary radiated field at the second frequency and distort the radiation pattern and input impedance of the second antenna 206.

The filter 203 is coupled to the first antenna 204. The filter 203 is preferably connected to the first antenna 204 at the first port 210 thereof. The filter 203 alters the termination impedance at the first port 210 of the first antenna 204 and reduces the induced currents from the first antenna 204 at the second frequency at which the second antenna 206 operates. Specifically, the induced currents at the second frequency along the first antenna 204 can be modified by altering the termination impedance at the first port 210 of the first antenna 204, and would be reduced by having an open circuit impedance condition at the first port 210 for the second frequency.

When the first and second antennas 204, 206 are operating at the same time, the filter 203 provides an open circuit impedance condition for the first antenna 204 at the second operating frequency at which the second antenna 206 operates, and a band pass frequency response for the first frequency at which the first antenna 204 operates. Accordingly, at the second frequency, the filter 203 blocks the current induced in the first antenna 204 from the second antenna 206 at the second frequency, thereby reducing or eliminating the potential for the first antenna 204 to be a secondary source of radiation at the second frequency. In addition, the filter 203 passes electrical current, or energy, to the first antenna 204 at the first frequency. Thus, the filter 203 effectively filters unwanted radiation at the second frequency that may otherwise degrade the radiation pattern of the second antenna 206 via secondary radiation from the first antenna 204, but does not interfere with the operation of the first antenna 204 at the first frequency.

For example, in the above-described example in which the first antenna 204 operates at a first frequency of 1.9 GHz and the second antenna 206 operates at a second frequency of 2.34 GHz, the filter 203 provides an open circuit impedance condition at 2.34 GHz and a band pass frequency response at 1.9 GHz. Accordingly, any distortion that may have been caused by the first antenna 204 at the second frequency (e.g., 2.34 GHz) would be significantly reduced or eliminated, while the operation of the first antenna 204 at the first frequency (e.g., 1.9 GHz) would be unaffected.

Turning now to FIG. 3, a functional block diagram is provided for a non-limiting example of the filter 203 of FIG. 2. As depicted in FIG. 3, the filter 203 includes an input port 302, an output port 304, a ground unit 307, a transmission line 306, a plurality of inductors 308, and a plurality of capacitors 310. The input port 302 is preferably connected to the first port 210 of the first antenna 204 of FIG. 2. The output port 304 is preferably connected to a receiver (not depicted) for the first antenna 204 of FIG. 2 that is preferably disposed inside the vehicle.

The electrical length of the transmission line 306 is preferably based at least in part upon the second operating frequency of the second antenna 206 of FIG. 2, so that the transmission line 306 adjusts the phase of the filter 203 to ensure that the desired open circuit condition is attained for the second frequency of the second antenna 206 of FIG. 2. In one example (described above) in which the first antenna 204 of FIG. 2 operates at a first frequency of 1.9 GHz and the second antenna 206 of FIG. 2 operates at a second frequency of 2.34 GHz, the transmission line 306 is preferably a microstrip that is approximately ten mils wide and 190 mils long. Also in this example, the substrate preferably comprises a FR4 material with a dielectric constant of 4.2, and has a height of approximately 23 mils. The electrical length of the transmission line 306 is preferably dependent on the dielectric substrate material property on which the transmission line 306 is printed and also upon the operating frequencies. Based on these facts, a skilled practitioner in the art of radio frequency (RF), microwave or antenna engineering field can easily measure and adjust the phase using various methods such as using a vector network analyzer.

The inductors 308 are coupled between the input port 302, the output port 304, and the ground unit 307. In the depicted example, the filter 203 includes three inductors 308, namely, a first inductor 312, a second inductor 314, and a third inductor 316. The first inductor 312 is coupled between the input port 302 and the output port 304. The second inductor 314 is coupled between the input port 302 and the first inductor 312. The third inductor 316 is coupled between the input port 302 and the ground unit 307. In the above-described example in which the first antenna 204 of FIG. 2 operates at a first frequency of 1.9 GHz and the second antenna 206 of FIG. 2 operates at a second frequency of 2.34 GHz, the first inductor 312 comprises an 8.9 nH inductor, the second inductor 314 comprises an 8.9 nH inductor, and the third inductor 316 comprises a 2.5 nH inductor. As the choice of the inductor values 312, 314, 316 preferably depends on the corresponding choice of capacitors, the filter realization as well as the dielectric substrate, they may vary in other examples.

The capacitors 310 are also coupled between the input port 302, the output port 304, and the ground unit 307. In the depicted example, the filter 203 includes three capacitors 310, namely, a first capacitor 318, a second capacitor 320, and a third capacitor 322. The first capacitor 318 is coupled between the input port 302 and the output port 304. The second capacitor 320 is coupled between the input port 302 and the first capacitor 318. The third capacitor 322 is coupled between the input port 302 and the ground unit 307. In the above-described example in which the first antenna 204 of FIG. 2 operates at a first frequency of 1.9 GHz and the second antenna 206 of FIG. 2 operates at a second frequency of 2.34 GHz, the first capacitor 318 comprises a 1.8 pF capacitor, the second capacitor 320 comprises a 1.8 pF capacitor, and the third capacitor 322 comprises a 6.3 pF capacitor. As the choice of the capacitor values 318, 320, 322 depends on the corresponding choice of inductors, the filter realization as well as the dielectric substrate, these may vary in other examples.

The filter 203 reduces secondary radiation and mutual coupling between the antennas 202 of FIG. 2. For example, the filter 203 reduces or eliminates distortion in the second frequency band of the second antenna 206 of FIG. 2 by creating an open circuit condition at the second frequency band, so as to effectively disconnect the first antenna 204 (from the perspective of the second antenna 206) and reduce or eliminate secondary radiation from the first antenna 204 at the second frequency. The filter 203 accomplishes these features as part of the antenna system 200 without affecting the operation of the first antenna 204 of FIG. 1 at its first frequency operating band. In addition, the antennas 202 of FIG. 2 need not be altered in order to accomplish these features.

It will be appreciated that in certain examples the filter 203 may vary from that depicted in FIG. 3 and described above. For example, as noted above, the type of transmission line 306 may vary. Similarly, the number, type, and/or configuration of the inductors 308 and/or capacitors 310 may vary. It will similarly be appreciated that, in certain examples, the filter 203 may be instead coupled to another one of the antennas 202 of FIG. 2, instead of or in addition to the first antenna 204 of FIG. 1. For example, a second filter may be coupled to the second port 212 of the second antenna 206 of FIG. 2 to reduce unwanted distortion for one or more of the first and/or third antennas 204, 208, and/or an additional filter may be coupled to a non-depicted port of one or more of a third antenna 208 of FIG. 2 to reduce unwanted distortion for one or more of the first and/or second antennas 204, 206, among other possible variations.

FIG. 4 is a first non-limiting, exemplary graphical representation 400 of simulation data illustrating the effectiveness of the antenna system 200 of FIG. 2 and the filter 203 of FIGS. 2 and 3. Specifically, the graphical representation 400 includes various plots of radiation of an exemplary antenna, such as the second antenna 206 of FIG. 2. The exemplary plots pertain to such an antenna operating at an exemplary frequency of approximately 2.34 GHz at an elevation angle of ninety degrees (with zero degree being the zenith). A first plot 402 provides a radiation pattern for such an antenna operating in isolation, and not in proximity to other antennas. A second plot 404 provides a radiation pattern for such an antenna operating in close proximity to another antenna, such as the first antenna 204 of FIG. 2, without the filter 203 of FIGS. 2 and 3. A third plot 406 provides a radiation pattern for such an antenna operating in close proximity to another antenna, such as the first antenna 204 of FIG. 2, in which the first antenna 204 is connected to the filter 203 of FIGS. 2 and 3. As shown in FIG. 4, the radiation pattern of the second plot 404 is distorted due to the presence of secondary radiation and mutual coupling between the first and second antennas. However, also as shown in FIG. 4, the distortion in the radiation pattern is significantly reduced with the inclusion of the filter, as represented in the third plot 406.

Figure 5:
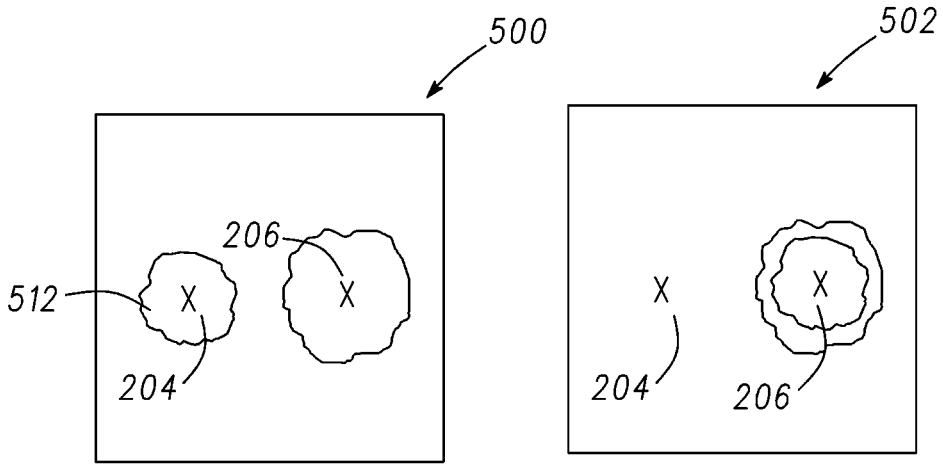
FIG. 5 is a second non-limiting, graphical representation, namely, a series of near-field plots, further illustrating the effectiveness of the antenna system of FIG. 2 and the filter of FIG. 3.

FIG. 5 is a second non-limiting, exemplary graphical representation of simulation data illustrating the effectiveness of the antenna system 200 of FIG. 2 and the filter 203 of FIGS. 2 and 3. Specifically, FIG. 5 provides a first near field plot 500 and a second near field plot 502 for a first antenna and a second antenna, such as the first antenna 204 and the second antenna 206 of FIG. 2. In this example, the first antenna operates at a frequency of 1.9 GHz, and the second antenna operates at a frequency of 2.34 GHz. For the first near field plot 500, the first antenna is disposed near the second antenna, with no filter. For the second near field plot 502, the first antenna is disposed near the second antenna, and a filter (such as the filter 203 of FIG. 2 and described above) is connected to the first antenna.

As depicted in the first near field plot 500, significant secondary radiation and mutual coupling may occur without the use of the filter 203 of FIGS. 2 and 3. Specifically, in the first near plot 500, a second field 512 is present near the second antenna without the filter 203 of FIGS. 2 and 3. In contrast, the second near field plot 502 demonstrates that the secondary radiation and mutual coupling can be significantly reduced or eliminated with the use of the filter 203 of FIGS. 2 and 3.

FIG. 6 is a third non-limiting, exemplary graphical representation of simulation data illustrating the effectiveness of the antenna system 200 of FIG. 2 and the filter 203 of FIGS. 2 and 3. Specifically, FIG. 6 provides a graphical representation of a first return loss 602 associated with a first antenna (such as the first antenna 204 of FIG. 2) and a second return loss 604 of a second antenna (such as the second antenna 206 of FIG. 2). In this example, the first antenna operates at a frequency of 1.9 GHz, and the second antenna operates at a frequency of 2.34 GHz. The first and second antennas are disposed in close proximity to one another, and the first antenna has a filter 203 connected thereto (for example, as depicted in FIGS. 2 and 3 and described above in connection therewith). As demonstrated by the first return loss 602 and the second return loss 604 of FIG. 6, the first and second antennas operate effectively, as intended, at their respective operational frequencies of 1.9 GHz and 2.34 GHz, with little or no mutual coupling or secondary radiation between the antennas.

Accordingly, improved antenna systems and filters are provided. The disclosed antenna systems and filters provide for enhanced operation of antennas in situations in which multiple antennas of different operating frequencies are disposed in close proximity to one another, such as on the windshield or on the roof of an automobile or other type of vehicle. A first antenna is coupled to a filter that is configured to allow radiation to pass to the first antenna at the first antenna's operating frequency, and that blocks, or filters, unwanted secondary radiation from emanating from the first antenna to the second antenna at the second antenna's operating frequency by creating an open circuit condition at the second antenna's operating frequency. Accordingly, mutual coupling is reduced, as the unwanted secondary radiation to the second antenna is reduced without adversely affecting the operation of the first antenna.

It will be appreciated that the disclosed systems and components thereof may differ from those depicted in the figures and/or described above. For example, the communication system 10, the telematics unit 24, and/or various parts and/or components thereof may differ from those of FIG. 1 and/or described above. Similarly, the antenna system 200, the antennas 202, the filter 203, and/or various parts or components thereof may differ from those of FIGS. 2 and 3 and/or described above, and/or the simulation results may differ in certain examples from those depicted in FIGS. 4-6.

Similarly, it will similarly be appreciated that, while the disclosed systems are described above as being used in connection with automobiles such as sedans, trucks, vans, and sports utility vehicles, the disclosed systems may also be used in connection with any number of different types of vehicles, and in connection with any number of different systems thereof and environments pertaining thereto.

While at least one example has been presented in the foregoing detailed description, it should be appreciated that a vast number of variations exist. It should also be appreciated that the detailed description represents only examples, and is not intended to limit the scope, applicability, or configuration of the invention in any way. Rather, the foregoing detailed description will provide those skilled in the art with a convenient road map for implementing the examples. It should be understood that various changes can be made in the function and arrangement of elements without departing from the scope of the invention as set forth in the appended claims and the legal equivalents thereof.

What is claimed is:

1. An antenna system comprising:

a first antenna configured to operate at a first frequency; and a filter coupled to the first antenna, the filter configured to create a band pass frequency response for the first antenna at the first frequency, the filter further configured to create an open circuit condition for the first antenna at a second frequency that is different from the first frequency and reduce secondary radiation from the first antenna at the second frequency, the filter further configured to create a band pass frequency response at the wherein the second frequency comprises an operating frequency of a second antenna proximate the first antenna, wherein the open circuit condition comprises an open circuit termination impedance condition that blocks the signals of the second antenna at the second frequency from passing through the filter while the band pass frequency response allows the signals of the first antenna at the first frequency to pass through the filter.

2. The antenna system of claim 1, wherein the filter comprises:

an input port configured to be coupled to the first antenna;

an output port configured to be coupled to a receiver for the first antenna;

a combination of inductors and capacitors; and a transmission line coupled between the input port or the output port and the combination of the inductors and capacitors, the transmission line between the input port, and the combination of the inductors and capacitors configured to adjust a phase of the filter to generate the open circuit condition at the second frequency;

a ground unit;

an inductor coupled between the input port and the ground unit; and a capacitor coupled between the input port and the ground unit.

3. The antenna system of claim 2, wherein the filter further comprises:

a second inductor coupled between the input port and the inductor; and a second capacitor coupled between the input port and the capacitor;

a third inductor coupled between the second inductor and the output port; and a third capacitor coupled between the second capacitor and the output port.

4. The antenna system of claim 2, wherein the electrical length of the transmission line is based upon the second operating frequency so that the transmission line adjusts the phase of the filter so that that the open circuit condition is created electrically for the second frequency.

5. The antenna system of claim 1, wherein the filter is configured to create the open circuit condition electrically at the second frequency by blocking current induced in the first antenna from the second antenna at the second frequency and passing electrical current to the first antenna at the first frequency while the first antenna and the second antenna are operating at the same time.

6. A filter for an antenna system comprising a first antenna configured to operate at a first frequency and a second antenna configured to operate at a second frequency that is different from the first frequency, the filter comprising:

an input port configured to be coupled to the first antenna;

an output port configured to be coupled to a receiver for the first antenna; and a transmission line coupled between the input port and the output port, the transmission line configured to adjust a phase of the filter to generate a band pass frequency response for the first antenna at the first frequency and an open circuit condition for the first antenna at the second frequency, wherein the open circuit condition comprises an open circuit termination impedance condition that blocks the signals of the second antenna at the second frequency from passing through the filter while the band pass frequency response allows the signals of the first antenna at the first frequency to pass through the filter.

7. The filter of claim 6, further comprising:

a ground unit;

an inductor coupled between the input port and the ground unit; and a capacitor coupled between the input port and the ground unit.

8. The filter of claim 7, further comprising:

a second inductor coupled between the input port and the inductor; and a second capacitor coupled between the input port and the capacitor;

a third inductor coupled between the second inductor and the output port; and a third capacitor coupled between the second capacitor and the output port.

9. The filter of claim 6, wherein the electrical length of the transmission line is based upon the second operating frequency so that the transmission line adjusts the phase of the filter so that that the open circuit condition is created electrically at the second frequency, and wherein the filter is configured to create the open circuit condition electrically at the second frequency by blocking current induced in the first antenna from the second antenna at the second frequency and passing electrical current to the first antenna at the first frequency while the first antenna and the second antenna are operating at the same time.

10. An antenna system comprising:

a first antenna configured to operate at a first frequency;

a second antenna configured to operate at a second frequency that is different from the first frequency; and a filter coupled to the first antenna, the filter configured to create a band pass frequency response for the first antenna at the first frequency, the filter further configured to create an open circuit condition for the first antenna at the second frequency and reduce secondary radiation from the first antenna at the second frequency, wherein the open circuit condition comprises an open circuit termination impedance condition that blocks the signals of the second antenna at the second frequency from passing through the filter while the band pass frequency response allows the signals of the first antenna at the first frequency to pass through the filter.

11. The antenna system of claim 10, wherein:

the first antenna comprises a monopole antenna; and the second antenna comprises a patch antenna.

12. The antenna system of claim 10, further comprising:

a housing comprising a windshield of the vehicle, wherein the first antenna, the second antenna, and the filter are disposed within the housing.

13. The antenna system of claim 10, wherein the filter comprises:

an input port configured to be coupled to the first antenna;

an output port configured to be coupled to a receiver for the first antenna; and a transmission line coupled between the input port and the output port, the transmission line configured to adjust a phase of the filter to generate the open circuit condition at the second frequency.

14. The antenna system of claim 13, wherein the filter further comprises:

a ground unit;

an inductor coupled between the input port and the ground unit; and a capacitor coupled between the input port and the ground unit.

15. The antenna system of claim 14, wherein the filter further comprises:

a second inductor coupled between the input port and the inductor; and a second capacitor coupled between the input port and the capacitor;

a third inductor coupled between the second inductor and the output port; and a third capacitor coupled between the second capacitor and the output port.

16. The antenna system of claim 13, wherein the electrical length of the transmission line is based upon the second operating frequency so that the transmission line adjusts the phase of the filter so that that the open circuit condition is created electrically for the second frequency.

17. The antenna system of claim 10, wherein the filter is configured to create the open circuit condition electrically at the second frequency by blocking current induced in the first antenna from the second antenna at the second frequency and passing electrical current to the first antenna at the first frequency while the first antenna and the second antenna are operating at the same time.

18. The antenna system of claim 10, wherein:

the first antenna is selected from the group consisting of a cellular monopole antenna and a PCS monopole antenna; and the second antenna comprises a satellite radio patch antenna.

19. The antenna system of claim 10, wherein:

the first antenna comprises a PCS monopole antenna; and the second antenna comprises a satellite radio patch antenna.

20. The antenna system of claim 10, wherein the filter is configured to create the band pass frequency response and the open circuit condition without altering the first antenna and without altering the second antenna.

* * * * *